United States Patent [19]

Ritter

[11] 4,373,765

[45] Feb. 15, 1983

[54] PLUG CONNECTION FOR RIBBON CABLES

[75] Inventor: Friedhelm A. Ritter, Gilching, Fed. Rep. of Germany

[73] Assignee: Raychem GmbH, Fed. Rep. of Germany

[21] Appl. No.: 268,072

[22] Filed: May 27, 1981

Related U.S. Application Data

[63] Continuation of Ser. No. 56,227, Jul. 10, 1979, abandoned.

[30] Foreign Application Priority Data

Jul. 14, 1978 [DE] Fed. Rep. of Germany ... 7821233[U]

[51] Int. Cl.[3] ..... H01R 23/66

[52] U.S. Cl. ..... 339/75 MP; 339/176 MF

[58] Field of Search ..... 339/75 M, 75 MP, 17 F, 339/176 MF

[56] References Cited

U.S. PATENT DOCUMENTS

| | | | |
|---|---|---|---|
| 3,149,896 | 9/1964 | Hall | 339/17 F |
| 3,226,668 | 12/1965 | Baer et al. | 339/176 MF |
| 3,267,410 | 8/1966 | Baer et al. | 339/176 MF |
| 3,594,699 | 7/1971 | Jayne et al. | 339/75 MP |
| 3,691,509 | 9/1972 | Krol | 339/17 F |
| 3,970,353 | 7/1976 | Kaufman | 339/75 MP |
| 4,066,840 | 1/1978 | Allgaier | 339/176 MF |
| 4,172,626 | 10/1979 | Olsson | 339/176 MF |

FOREIGN PATENT DOCUMENTS

| | | |
|---|---|---|
| 2017066 | 10/1970 | Fed. Rep. of Germany . |
| 2438878 | 7/1976 | Fed. Rep. of Germany . |
| 2093823 | 1/1972 | France . |
| 1158189 | 7/1889 | United Kingdom . |
| 1275320 | 5/1972 | United Kingdom . |
| 1295138 | 11/1972 | United Kingdom . |
| 1327194 | 8/1973 | United Kingdom . |
| 1364320 | 8/1974 | United Kingdom . |
| 1493784 | 11/1977 | United Kingdom . |

*Primary Examiner*—John McQuade

*Attorney, Agent, or Firm*—Lyon & Lyon

[57] ABSTRACT

A connection for a ribbon cable wherein the cable conductors are bared to provide plug pins insertable into a socket member, and the cable has depressions or through holes between the conductors, which are engaged by projections within guiding extensions of the socket member to anchor the pins in the socket member. The cable may be doubled over and the conductors bared at the resulting U-bend to form a connection at any point along the cable, and the projections preferably enter a plurality of the depressions or holes in a symmetrical pattern from opposite sides of the cable. This connection has the advantages of low total volume and high resistance to mechanical jolting and vibration in use.

14 Claims, 10 Drawing Figures

PLUG CONNECTION FOR RIBBON CABLES

This is a continuation, of application Ser. No. 56,227, filed July 10, 1979, now abandoned.

DESCRIPTION

This invention relates to a plug connection for ribbon cables consisting of several conductors arranged parallel to one another and embedded far in a resilient plastics ribbon comprising a socket member and a plug member received by the socket member, wherein the plug member is formed by the ribbon cable either having a small end portion of the conductors exposed to form contact pins for this purpose, or having a U-shaped loop which is freed from the plastics ribbon in the area of the bend to form contact pins from the curved conductors, and wherein the socket member is of a suitable design, e.g., a female multipoint connector with sockets, in particular fork contacts, for receiving the plug contact pins. The invention is well suited to flat conductor ribbon cables in which conductors having a flat cross-section are used.

In plug connectors of this type the ribbon cable itself is used as the plug member, preferably in the form described in our German Offenlegungsschrift No. 24 38 878, and the usual increase in the contact resistance when contact pins are soldered on or otherwise attached is thus avoided. However, known plug connections for ribbon cable tend to have a comparatively large volume, which is undesirable or unacceptable in many applications.

The present invention provides a very flat, space-saving and cheap form of plug connection which can tolerate severe oscillations and jolts in service at high alternating accelerations.

The invention accordingly provides a plug connection for a ribbon cable consisting of several conductors arranged parallel to one another and embedded in a plastics ribbon, the connection comprising a socket member and a plug member received by the socket member in use, wherein the plug member comprises the conductors of the ribbon cable exposed to form contact pins, wherein the socket member is of a suitable design with sockets for receiving the plug contact pins; and wherein the plug member includes one or more depressions or through holes in the plastics material of the ribbon cable, and the socket member has projecting guide sections which in use receive between them the section of the plug member including the said depression(s) or through hole(s), at least one of the guide sections having at least one projection capable of engaging the depression(s) or hole(s) to removably anchor the plug member in the socket member.

The portions of the conductors exposed to form the contact pins may be at an end of the cable, or may be intermediate. The cable may be doubled over either at an end or at an intermediate region to form a U-shaped loop, the arms of which are in contact with one another and in the area of the bend are freed of the insulating plastics ribbon to allow the doubled-over exposed portions of the conductors to form contact pins. Alternatively a portion of the conductors may be freed from the plastics insulation of the cable so that the conductors form pins of a single conductor thickness.

Advantageously both guide sections have one or more projections. Preferably both sections have a plurality of projections, which are advantageously disposed on a line transverse, preferably perpendicular, to the conductor direction.

The invention also provides a plug member, and a socket member, suitable for making the connection.

At least first and second detect cams or projections are preferably provided to engage respectively first and second depressions or holes, the projections preferably being alternately placed on the one and the other of the guide sections i.e. according to the alligator principle, that is to say, they engage in alternation from either side, and the depressions or holes are preferably between the conductors.

Surprisingly, the plug member can still be plugged sufficiently easily into the socket member in spite of the detent cams that are provided. We have found that the end of the plug member or of the plug contact area of the ribbon cable has sufficient inherent rigidity to be pushed into the cooperating contacts, in particular fork contacts or the like, of the socket member, as opposed to the much gentler insertion required by known connectors. The protuberant guide sections are preferably injection-moulded on to the socket body and are preferably made of appropriately resilient plastics or insulating material.

The design according to the present invention leads to a considerably greater capacity to take the strain of high alternating accelerations than in the case of known conventional plug connector which are not secured, since a longitudinal displacement of the contact pins in the co-operating contacts or sockets of the socket member, which could result in the electrical contact being impaired or broken, tends to be prevented. The preferred design according to the invention also increases the lateral control of the plug member in the socket member, i.e. reduces a possible lateral swinging about an axis perpendicular to the ribbon cable.

Embodiments of a plug connector according to the invention are described in more detail with reference to the attached drawings in which:

FIG. 1 is a plan view of the plug member according to the invention;

FIG. 2 is a lateral view of the plug member, one end of a ribbon cable (a) and a loop (b), FIG. 3 is a longitudinal section through the socket member, FIG. 4 is a front view of the socket member according to FIG. 3, FIG. 5 is the socket member according to FIG. 3 with the plug member according to FIG. 2(*b*) plugged in, FIG. 6 shows a view from below of an alternative form of the plug member (end and middle positions on the cable) having two depressions or holes located towards the centre of the cable, FIG. 7 shows a side view of the plug member shown in FIG. 6;

Figure 1:
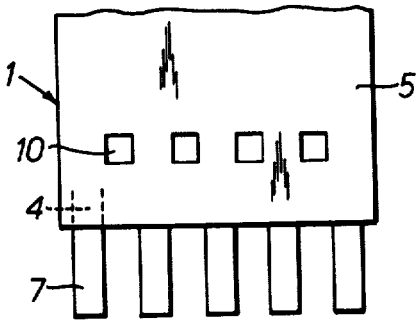

Referring to FIGS. 1 to 5 of the drawings, the connection according to the invention consists of a plug member 1 and a socket member 2. The plug member 1 is formed by a ribbon cable which has five parallel conductors 4 having a flat cross-section and arranged at the normal spacing of 2.54 mm. The conductors 4 are embedded in a plastics ribbon 5 made of insulating material. At the end of the ribbon cable a small portion of the conductors 4 is exposed to form contact pins 7, see FIGS. 1 and 2(*a*). In the embodiment according to FIG. 2(*b*) a U-shaped loop is formed at the end of the ribbon cable, the arms of which are connected to one another. In the area of the bend the relevant sections of the plastics ribbon are removed in order to form the contact pins 7 from the curved conductors 4. Such a U-shaped loop can be made anywhere along the cable to provide interconnections.

Figure 2:
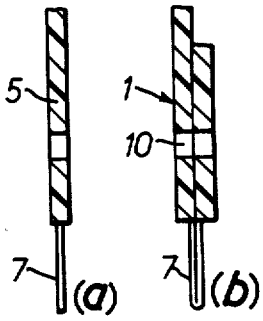
Figure 3:
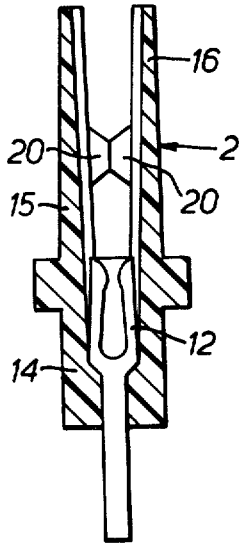

Through holes 10 are provided between the conductors 4 in the plug member thus formed, see FIGS. 1 and 2. The width of these holes is no greater than the clear distance between the conductors 4. Instead of the holes it is possible merely to provide depressions which may be produced for example when connecting the arms of a U-shaped plug to each other as shown in FIG. 2(*b*), for example by ultrasonic welding.

The socket member 2 is of a form similar to a female multipoint connector made of insulating material with inserted fork contacts 12 and has guide sections 15 and 16 projecting from the actual socket body 14 between which the plug member 1 is received. The socket member 2 is of substantially the same width as the ribbon cable, or the plug member 1, but may also be wider. The two guide sections 15 and 16 have detent cams 20 engaging from either side in the holes 10, the two central cams being provided in the guide section 15 and the two outer cams being provided in the guide section 16, see FIG. 4. Thus the plug member 1 operates in the manner or an alligator, i.e. is gripped from the one and the other side in alternation, but symmetrically. Of course, other distributions of the projections between the facing guide sections could be used, symmetrical patterns being preferred, and the number of conductors and of depressions or holes is not critical.

Figure 5:
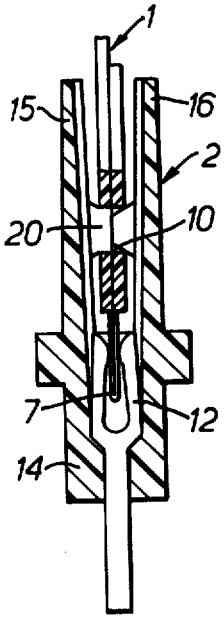
Figure 4:
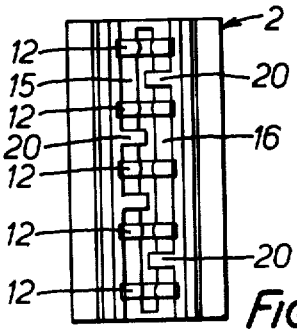

FIG. 5 shows the plug member 1 according to FIG. 2(*b*) introduced into the socket member 2. The detent cam 20 of the guide section 15 is shown in engagement with the hole 10 of the plug member. In this manner the holding of the plug member in the socket member is assisted by the cam 20 so that the plug connector can be subjected to considerably greater alternating accelerations without the contact pins 7 being displaced longitudinally in the fork contacts 12.

Figure 6:
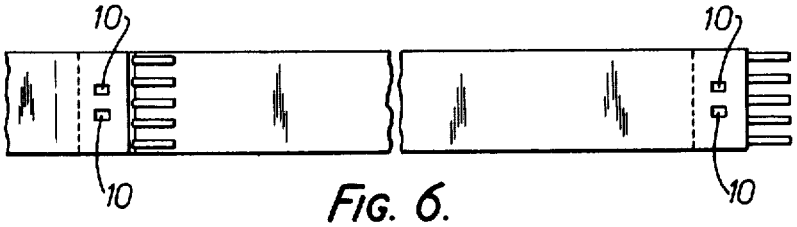
Figure 7:
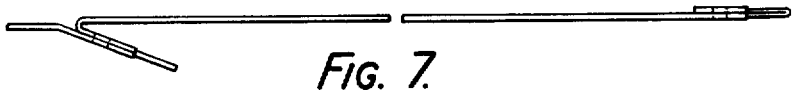
Figure 8:
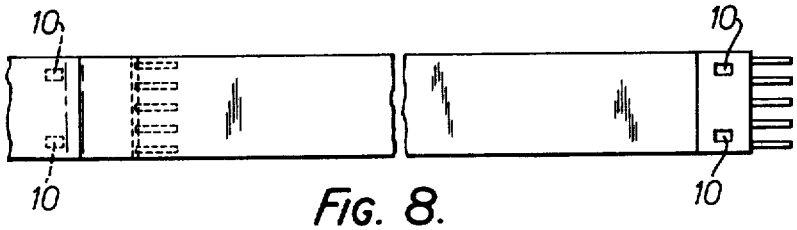
FIG. 8 shows (from above, in the sense opposite to that of FIG. 6) another alternative plug member (end position on the cable) having two depressions or holes located toward the edges of the cable.

The design according to the invention minimizes the volume of the plug connection. The production costs of the socket member are practically the same. The through holes 10 can be made in the plug member with a simple auxiliary tool similar to a punch which likewise hardly alters the cost of finishing the end section, and is readily applicable to making connections to intermediate sections of the cable. FIGS. 6 to 8 show alternatives forms of the plug member having two depressions or holes located towards the centre of the cable (FIG. 6) and towards the edges of the cable (FIG. 8). At least three depressions or holes symmetrically arranged are preferred, especially for wider cables. FIGS. 6 to 8 show both intermediate and end plug members.

Figure 9:
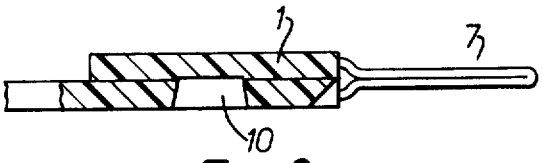
FIG. 9 shows in side cross-section an end portion of a ribbon cable which has been doubled over and stripped to form a plug pin.
Figure 10:
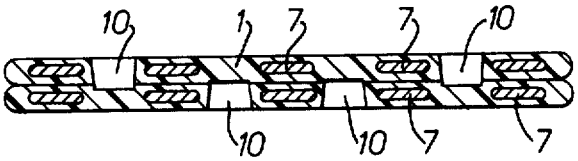
FIG. 10 shows an end cross-section of a doubled-over cable section with anchoring depressions according to the invention.

It will be understood that the "depressions" could be formed by punching through holes in one leg of the aforementioned U-bend plug before it is joined to the other leg thus sealing one end of the holes. This is shown in FIGS. 9 and 10 for the "alligator tooth" arrangement of FIGS. 1 to 5. FIGS. 9 and 10 also illustrate the preferred 10° outward slope of the sides of the individual depressions, and the preferred 45° taper of the insulation towards the bared conductors. The slope of the sides of the depressions or holes will influence the force required to pull the plug member out of the socket member, and it is a general advantage of the present invention that such disconnection can be effected without any need to unscrew parts or cut cable.

I claim:

1. A connection between a relatively flexible ribbon cable and a relatively rigid socket member, wherein said cable comprises a plurality of conductors extending substantially parallel to one another embedded in insulating material, said conductors being exposed along a portion of the cable to provide contact pins and at least two through-holes or at least one depression in each major surface of the cable, said through-holes or depressions being laterally spaced in said insulating material adjacent said contact pins, said cable thereby forming a plug member, and wherein said socket member comprises two integrally-formed guide portions substantially fixed relative to each other and defining therebetween a channel, electrical contact members disposed in said channel, and at least one relatively rigid projection extending from each guide portion into said channel, with said projections being spaced apart laterally along the length of the channel, aid plug member being receivable in said channel with said contact pins engaging said contact members and being removably anchorable in said channel by engagement from opposite sides between said projections and said through-holes or depressions with each of said through-holes or depressions being engaged by a single projection.

2. A connection according to claim 1, wherein one of said depressions or through-holes is provided between each pair of adjacent conductors of said plug member, and said socket member comprises a number of said projections equal to the number of said depressions or through-holes, said projections being spaced apart laterally on opposite sides of said channel to engage said depressions or through-holes from opposite sides of said plug member.

3. A connection according to claim 1 wherein for each said depression or hole only one of the guide portions carries a corresponding projection.

4. A connection according to claims 1 or 3, wherein said projections are distributed between the guide portions in a symmetrical pattern.

5. A connection according to claim 4, wherein two of said projections capable of engaging an adjacent pair of holes or depressions in the plug member are carried by one of the guide portions, and third and fourth projections capable of engaging respectively a third and fourth hole or depression aligned with and one on each side of the said pair are carried by the other guide portion.

6. A connection according to claims 1 or 2 wherein each said depression or hole is disposed between the conductors of the ribbon cable.

7. A connection according to claim 1 wherein said insulating material of the cable is removed from part of the cable around the conductors such that the bare conductors project as pins, and wherein the bare conductors and each said hole or depression in said cable is in a doubled-over section of the cable, the arms of the doubled-over portion being secured to each other.

8. A connection according to claim 7, wherein the holes or depressions in said cable are made in one arm of the doubled-over section of the cable before the arms thereof are secured to each other.

9. A connection according to claims 1 or 2, wherein each of said projections extends into said channel for substantially half the width thereof.

10. A connection according to claims 1 or 2, wherein said channel of the socket member is of substantially rectangular cross-section, has an open end arranged to receive said plug member therethrough, and an opposing closed end, said contact members of the socket member being located in said channel at said closed end, and wherein said projections of said socket member extend into said channel intermediate said open and closed ends thereof.

11. A connection according to claims 1 or 2, wherein each of said electrical contact members of the socket member comprises a socket portion for resiliently receiving therein a respective one of said contact pins of said plug member.

12. A connection according to claims 1 or 2, wherein a leading and trailing edge of each of said projections, in the direction of insertion of said plug member into said channel, is tapered to facilitate sliding movement thereover of said plug member.

13. A connection according to claims 1 or 2, wherein edges defining said depressions or through-holes extending transversely of said plug member are tapered to facilitate sliding movement of said plug member over said projections.

14. A connection according to claim 1, wherein two of said projections capable of engaging an adjacent pair of holes or depressions in the plug member are carried by one of the guide portions, and third and fourth projections capable of engaging respectively a third and fourth hole or depression aligned with and one on each side of the said pair are carried by the other guide portion.

* * * * *